US005993295A

United States Patent [19]

Raffaelli

[11] Patent Number: 5,993,295

[45] Date of Patent: Nov. 30, 1999

[54] POLISHING OF OPTICAL SURFACE OF AN OPHTHALMIC LENS

[75] Inventor: Dennis R. Raffaelli, Rochester Hills, Mich.

[73] Assignee: Inland Diamond Products Company, Madison Heights, Mich.

[21] Appl. No.: 09/013,442

[22] Filed: Jan. 26, 1998

Related U.S. Application Data

[63] Continuation-in-part of application No. 08/200,285, Feb. 22, 1994, Pat. No. 5,711,700.

[51] Int. Cl.[6] ..... B24B 1/00

[52] U.S. Cl. ..... 451/43; 451/57; 451/58; 451/255; 451/541

[58] Field of Search ..... 415/43, 53, 57, 415/58, 240, 255, 256, 541, 544, 545

[56] References Cited

U.S. PATENT DOCUMENTS

| | | |
|---|---|---|
| 4,300,317 | 11/1981 | Croft et al. . |
| 4,394,099 | 7/1983 | Santinelli . |
| 4,423,569 | 1/1984 | Stern et al. . |
| 4,512,108 | 4/1985 | Kobayashi . |
| 4,612,736 | 9/1986 | Massard et al. . |
| 4,667,444 | 5/1987 | Langlois et al. . |
| 4,807,398 | 2/1989 | Ramos et al. . |
| 4,829,715 | 5/1989 | Langlois et al. . |
| 4,885,875 | 12/1989 | Soper . |
| 5,027,561 | 7/1991 | Brule et al. . |
| 5,148,637 | 9/1992 | Byron . |
| 5,149,337 | 9/1992 | Watanabe . |
| 5,203,121 | 4/1993 | Metzger . |
| 5,384,987 | 1/1995 | Wiand ..... 451/41 |
| 5,410,843 | 5/1995 | Gottschald . |

FOREIGN PATENT DOCUMENTS

| | | |
|---|---|---|
| 4372352 | 12/1992 | Japan . |
| 639696 | 2/1994 | Japan . |

*Primary Examiner*—Timothy V. Eley
*Attorney, Agent, or Firm*—Harness, Dickey & Pierce, P.L.C.

[57] ABSTRACT

A process and apparatus for polishing an optical surface of an ophthalmic lens is provided. The process of the invention comprises the steps of roughing an optical surface of a polycarbonate lens substantially without coolant and passing a polishing wheel of the present invention over the surface of the lens with the use of coolant and then passing the polishing wheel over the surface of the lens substantially without coolant for at least one pass over the portion of the lens edge to be polished. A single abrasive wheel is used for machine polishing of the optical surface of the lens. The wheel is an impregnated wheel of from about 2 to about 60 micron diamond hardness abrasive particles in a concentration of from about 10 to about 200 concentration.

11 Claims, 1 Drawing Sheet

POLISHING OF OPTICAL SURFACE OF AN OPHTHALMIC LENS

CROSS-REFERENCE TO RELATED APPLICATIONS

This application is a continuation-in-part of U.S. application Ser. No. 08/200,285, filed Feb. 22, 1994, now U.S. Pat. No. 5,711,700 issued Jan. 27, 1998.

BACKGROUND OF THE INVENTION

The present invention relates to a process and apparatus for edging and polishing of an ophthalmic lens and, more specifically, a process and apparatus for edging and polishing a surface of an ophthalmic lens comprising polycarbonate, CR 39 or glass, wherein the step of edging and polishing may be performed with a single machine and the step of polishing may be performed with a single polishing wheel.

In an alternate embodiment, a process for simplified shaping and polishing of an optical surface of a lens is provided.

In the lens grinding industry a great number of ophthalmic labs have sprung up with the advent of modern bevel edger machines. These machines are capable of taking a lens blank and grinding a final shape of a lens for fitting of the lens in a particular frame. Thus, a lens blank of the proper prescription is rough cut to the rough shape of the frame and thereafter a bevel edge is ground on the lens such that the lens will properly fit in the glasses frame. Such procedures are known in the art and explained in the owner's manual of AIT and WECO bevel edger machines which are incorporated herein by reference. A final step of polishing the bevel edge is also employed to provide a lens edge with a high luster finish.

Typically, the steps of rough-cutting the lens, bevel edging and polishing are performed with different machines as required for various lens materials, i.e., polycarbonate, CR 39 or glass. The step of finishing also utilizes different grinding wheels depending on the lens material. This typically requires the lens grinding labs either to have separate machines with various grinding wheels or to send out work which cannot be done on a single existing machine commonly found in ophthalmic labs of today. The requirement of different machines is in part due to lenses made of polycarbonate require special wheels for grinding and typically utilize no coolant; whereas CR 39 plastic lenses require different wheel coolant or a lubricant (generally water) when grinding. This is because of the thermoplastic nature of the polycarbonate, which will flare in its thickness at the grinding edge if coolant or a lubricant is utilized during removal of material. Polycarbonates are therefore usually dry ground and thereafter polished at their edges on a separate machine. A further problem of combining the polycarbonate and CR 39 edging and polishing process is that a finishing wheel that is fine enough to polish CR 39 is too fine to grind polycarbonate lenses. The hardness of polycarbonate materials is also problematic because it causes excessive wear of polishing wheels commonly used for polishing of other materials.

Typically, the finishing and polishing steps are accomplished via two separate abrasive wheels with the "roughing" of the lens accomplished via a separate machine or a separate abrasive wheel in the same machine. In recent years, the market for ophthalmic lenses has become increasingly interested in achieving a polish on the edge of the lens which is equal in finish to the optical surfaces of the lens. In the past, this was accomplished by time consuming polishing with hand tools or the like. While there are a few mechanical polishing systems, they typically do not provide hand polished results and are exclusively used for a single type of lens material.

Additionally, shaping and polishing of a lens is very time consuming particularly in the lens lapping phase of the invention. This process requires lapping with several different grades of abrasives to reach the final optical and polished surface.

Thus, there remains a need in the art to provide a system for providing an optical quality polish on all common lens blank materials including polycarbonate, CR 39 plastic and glass on a single machine and polishing all common types of lens blank materials with a single polishing wheel system.

SUMMARY OF THE INVENTION

In accordance with the present invention, there is provided a process and apparatus for edging and polishing an ophthalmic lens comprising polycarbonate, utilizing a single finishing machine which is capable of polishing other materials, and utilizing a single polishing wheel system, wherein the final optical lens product has an edge surface polished to a substantially optical quality finish. The process of the present invention comprises the steps of first grinding a rough lens and thereafter polishing the first periphery of the lens with a dry cycle, and thereafter wet finishing the peripheral surface around the lens whereby an optical quality polished lens edge is the result.

In an alternate embodiment of the present invention, a polishing process is provided for polishing of optical surfaces of a lens. The process comprises rough grinding the lens and thereafter using a wet and then a dry cycle with a superfine micron wheel.

It is, therefore, an object of the present invention to provide a process and apparatus for providing an optical lens having an edge surface polished to a substantially optical quality finish. It is also an object of the present invention to provide a process and apparatus for bevel edging all common lens blank materials including polycarbonate, CR 39 and glass on a single finishing machine. It is a further object of the present invention to provide a process and apparatus for forming ophthalmic lenses whereby a finished lens may be provided wherein the beveled edge is polished without an external polishing device.

Further objects and advantages of the present invention will be realized by review of the intended specification including the description of the drawings, the description of the preferred embodiments and the claims appended hereto.

DETAILED DESCRIPTION OF THE PREFERRED EMBODIMENTS

Figure 1:
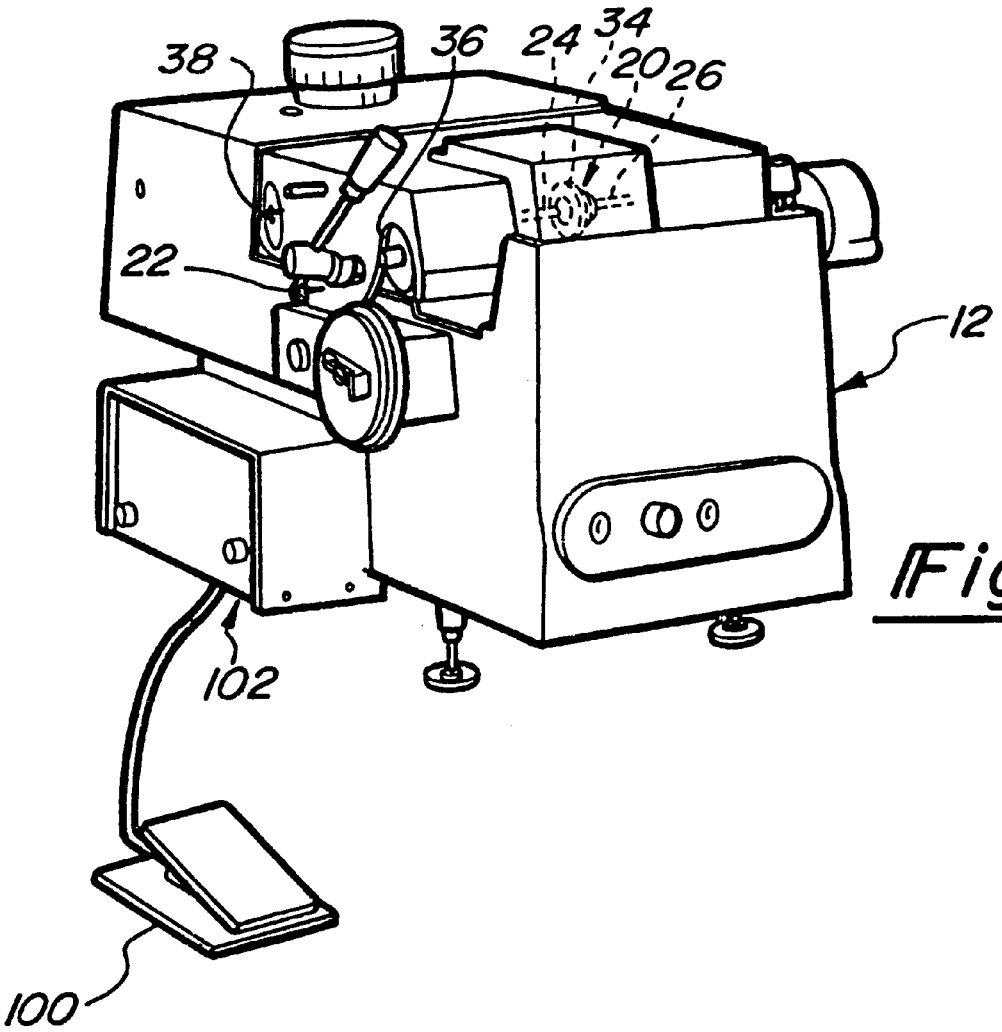
FIG. 1 is a perspective view of a bevel edger machine utilizing the process of the present invention.
Figure 2:
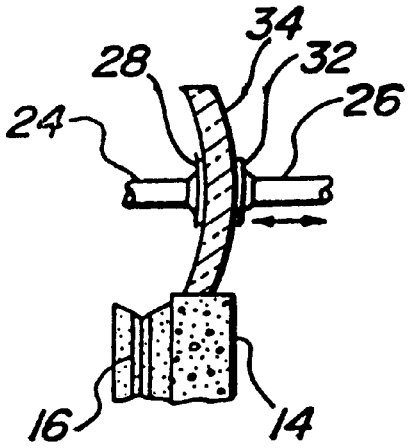
FIG. 2 is a detailed view of the polishing process of the present invention.

Referring now to the drawings, there is shown a typical lens bevel edger machine utilized in ophthalmic labs today. Such bevel edgers include a rough grind wheel 14 and bevel edger wheel 16 (best shown in FIG. 2) which are situated in the lens edging portion of the machine generally indicated at 18. Referring now to FIG. 1, bevel edger machines typically include a lens holding system generally indicated at 20 and a lens edge forming assembly generally indicated at 22. The lens holding assembly typically includes lens drive spindles 24 and 26 which grip a lens by way of lens blocks 28 and 32. Typically, blocking pads, as are known in the art, grip lens 34 for holding a lens during rough grinding and bevel edging of the wheel.

The lens former assembly 22 typically includes a lens shape template 36 which is a specific shape for a particular frame. The template 36 is rotationally coupled with shaft 24 such that as the template member turns, the lens 34 also turns. The lens grinding assembly is pivotable along an axis generally indicated at 38 such that as the lens rotates while it is engaging the grinding wheel 14, the lens former member actuates the lens up and down by interaction between the template 36 and the former member upon which it rests. Such former members are referred to by various names in the art, such as former wheel, copy wheel, wear plates former shoes or former plates.

In accordance with the process of the present invention, a single lens edger machine typical in the art can edge an optical lens comprising all common optical lens materials including polycarbonate, CR 39 and glass. Furthermore, the beveled edge of the lens may be polished with a single polishing wheel, without an external polishing device. In particular, normal wet polishing of CR 39 and glass may be accomplished using conventional techniques. Thus, the polishing wheels as disclosed herein may be used on plastic and glass lenses, other than polycarbonates using conventional wet grinding techniques. However, utilizing the process of the present invention also allows polishing of polycarbonate lenses on the same machine using the same wheels used for the other materials.

In accordance with the present invention, there is provided a process for polishing of a polycarbonate lens on the same machine and using the same wheel as used with a glass or methyl methacrylate lens. In accordance with the process aspects of the present invention, an optical lens blank made of a polycarbonate material is provided in a roughed condition. In this condition, the polycarbonate lens includes a finished optical surface and the roughed lens edge. A finishing apparatus is provided which is used for polishing at least a portion of the edge surface of the lens to contact the finishing apparatus for one cycle without the use of any coolant or lubricant, and one cycle with the use of a coolant or lubricant. Thus, the process of the present invention comprises the steps of edging a lens either without coolant or with a substantially diminished coolant flow, i.e. less than about 8 ounces per minute, wherein the preferred coolant is water. The roughedged lens is then polished with a finishing apparatus, such as a polishing wheel of the present invention, by first passing the polishing wheel over the surface of the lens for at least one full revolution of the lens ("cycle") substantially without the use of coolant ("dry"), and then passing the polishing wheel over the surface of the lens for at least one full revolution of the lens with the use of coolant ("wet"). In a preferred process of the present invention, at least one dry polishing cycle is made before the wet polishing cycle is begun, and thereafter three to four wet polishing cycles are used to achieve the final polish of the lens edge. Utilizing the process of the present invention results in a polished lens edge which is substantially the same as the quality of finish of the optical surface of the lens. While the use of a wheel type finishing apparatus is preferred for use in the present invention, other types of polishing devices can be used to achieve the optical quality polish by using the method of the present invention without deviating from the scope of the present invention.

The process of the present invention may be used to polish any "roughed" lens. By the terms "roughed", "rough ground", "rough edge surface" or the like, it is meant that a lens which has been shaped to the shape required for attachment or insertion into an eyeglass frame. Typically, such lenses have an abraded edge surface which requires further finishing and polishing of the surface to obtain an acceptable lens edge finish. Thus, a typical roughed lens would include a bevel for insertion into a lens frame which is fabricated on the roughing cycle of the bevel edger machine. However, in certain eyeglass frames, the edge of the lens may be roughed in a flat edge or other shape which is thereafter polished via the process of the present invention.

The polishing wheel of the present invention may be used to polish all common optical lens materials including polycarbonate, CR 39 and glass. The polishing wheel of the present invention is impregnated with diamond grit particles in concentrations of generally from about 10 to about 200 concentration, typically from about 35 to about 150 concentration, and preferably from about 75 to about 125 concentration, (where 4.4 carats/cubic centimeter is equal to 100 concentration). A preferred abrasive grit of the present invention is diamond particles. The abrasive grit material used generally ranges from about 2 to about 60 microns, and typically from about 7 to about 30 microns. In some circumstances, 15 to about 20 micron particle sizes will work, while in other cases 8 to about 12 micron particles are preferred. The final particle size is somewhat dependant on the particular machine on which the wheel is used and the polish desired. Other diamond-like hardness materials would also be useful such as cubic boron nitride, corundum, polycrystalline diamond, silica carbide and tungsten carbides.

The polishing wheel of the present invention may be either a sintered wheel, a resin bonded wheel or the like, provided it contains abrasive particles in the size and quantities specified above which are critical for polishing of both polycarbonates and other materials. A metal matrix of a specific gravity of not less than 3.50 g/cc, and not more than 10.6 g/cc, is preferred. Preferably, a sintered metal bond is utilized which contains from about 400 to about 600 grams copper, from about 20 to about 100 grams tin, and from about 2 to about 15 grams of graphite as a sintering binder for the abrasive grit.

In accordance with the present invention, a cut-off switch 100 or the like is wired to the coolant pump (generally indicated at 102) of the bevel edger machine or the pump is otherwise disengaged from operation. Thereafter, the polishing wheel of the present invention is mounted on the bevel edger, and a polycarbonate lens blank is rough ground and bevel edged without coolant or lubricant. After the bevel edge is complete, the coolant flow is resumed and the machine is allowed to cycle for one pass over the portion of the lens edge to be polished. Thus, if the entire edge of the lens is to be polished, one full revolution is utilized. However, if only a portion of the lens is desired to be polished, then only that portion of the lens which needs polishing is contacted. This final step accomplishes a final polishing of the lens edge which is as good or better than that achieved on a separate polishing machine.

A foot switch is preferred for the pump power cut-off. Since the coolant pump of a bevel edger machine is typically connected separately to the wall socket, an in-line cut-off switch, wherein the plug of the pump may be connected to the switching plug of the foot switch, is utilized. This is then connected to a suitable outlet. Thus, an operator can step on the foot switch to cut coolant flow when grinding the polycarbonate lens, and release the foot switch for allowing coolant flow for final polishing of the lens.

In a second embodiment, the bevel edger apparatus could be programmed to provide the process set forth above automatically. Thus, an integrated circuit chip or the like with the proper programming, to allow automatic processing of a lens under the process steps of the present invention, could be utilized to vary the processing when polishing of a polycarbonate lens. This would be accomplished by programming the bevel edger to interrupt coolant flow for at least one cycle when finishing of a polycarbonate lens and rough edging the polycarbonate lens without the use of coolant. Also, many of the machines now available are operator programmable which would allow programmable control of the process. Thus, a machine could be provided for automatically carrying out the process, with the only necessary input from the operator being selection of the type of lens blank to be edged.

In a second alternate embodiment of the present invention, it has been found that the process used for edge polishing of diamond wheels can advantageously be used for optical surfaces of polycarbonate lenses. In accordance with the broad aspects of this invention, the optical surface of a polycarbonate lens is first ground with a rough grinding wheel having a radiused edge portion as is conventional in the art. Thereafter, a micro-fine abrasive radiused edge wheel is utilized for fine polishing of the optical surface of the polycarbonate lens. The polishing step is accomplished by first wet polishing of the lens with coolant flow and thereafter dry polishing of the lens with this wheel.

Thus, in accordance with the process of the present invention, the polishing of an optical surface of a polycarbonate lens is provided by first providing an optical lens made of a polycarbonate material which has a rough optical surface. A rough-forming wheel is then provided which has a radiused edge. The final optical curvature of the optical surface is rough ground with this rough grinding wheel using conventional machinery. Thereafter, a polishing wheel having a radiused edge is provided. The polishing edge preferably has abrasive particles of the size of from about 2 microns to about 60 microns with preferred sizes being from about 10 to about 30 microns. Preferably, the wheel is an impregnated polishing wheel which has a concentration of from about 10 to about 200 concentration of abrasive grip material and preferably from about 35 to about 150 concentration. In a particular preferred embodiment, the polishing wheel has from about 75 to about 125 concentration diamond particles in the range of 7 to 30 microns. Depending on the material used, ranges of from 15 to 20 microns may be used or 8 to 12 microns. The lenses thereafter are polished, or at least a portion thereof is polished, by causing the polishing wheel to contact the optical surface to be polished at least once with a coolant flow. Thereafter, the polishing wheel is caused to contact the portion of the optical surface to be polished at least once without the use of coolant flow, or coolant flow of less than about 8 ounces per minute. Thereafter, a final finish is accomplished.

If further polishing is required, and sometimes it might be, the conventional lapping of very fine polishing grits using conventional lapping tools may also be included as a step of the present invention.

Conventional apparatus and wheel speeds may be utilized with the process of the present invention. Optical quality surfaces may be obtained utilizing only two different wheels with very little final lapping of the lenses required. When utilizing the process of the present invention, the optical surface of a lens may be ground and polished with more precision then was conventionally found. In the past, for instance, more precision may be utilized by using only two or three passes of the rough grinding and polishing wheels with only a small amount of lapping required to prepare the optical surface for vision. In the past, much lapping of the lens was required after the rough grinding step to create the final polish. This resulted in aberrations of the lens and out of spec conditions. Thus the present process improves previous optical grinding and polishing steps by reducing the number of steps required.

EXAMPLE I

A metal bond mixture was formulated using 545 grams of copper powder, 61 grams of tin powder and 9 grams of graphite. One hundred and forty-seven (147) carats of 10/15 micron diamonds were mixed with 270 grams of the above mentioned metal bond mixture. The diamond metal bond mixture was then placed in a mold with a cavity for forming a bevel polish wheel and sintered at a temperature of 1300° F. by hot-pressing.

The polish wheel is then fitted to a Gerber "ELITE". A polycarbonate lens blank was first rough edged without coolant flow. The lens is then bevel edged without coolant flow to the lens. The lens is then polished one revolution without coolant. Thereafter, four cycles are used with coolant to provide the final polish to the edge of the lens. The resulting polished lens edge is of an extremely high luster (i.e. optical quality resulting in a very pleasing aesthetic appearance).

EXAMPLE II

A polishing wheel was formulated using a resinous binder as follows. A binder mixture is formulated from a mixture of 600 grams phenolic resin, 100 grams copper powder, 60 grams silica carbide #1000, 60 grams aluminum oxide, and 5.8 grams of graphite. Forty-five (45) grams of this bond mixture was then mixed with 50 carats of 10/20 micron diamond. A rough form of a bevel polish wheel was prepared by compression molding the bond/diamond mixture at a temperature of 325° F. This rough blank is then further fabricated into a bevel polish wheel for a WECO Model 440 edger.

The resulting wheel was installed on a WECO Model 440 edger. A polycarbonate blank was "roughed out" using a conventional wheel in the edger without the use of coolant. Thereafter, the lens was polished using the wheel prepared as above. The cycle used was one dry revolution of the lens against the rotating polish wheel, with four final revolutions of the lens against the polishing wheel, with coolant flow to the wheel. The resulting lens had edges of extremely high luster approaching optical quality of the lens.

EXAMPLE III

Using the bond material of Example I, several polishing wheels are made in the following diamond concentrations: 10, 50, 75, 125, 180 and 200. In each of these concentrations, wheels are made using 2 micron, 10 micron, 30 micron and 60 micron sizes of diamond.

Each of the above wheels is used to polish optical surface of a polycarbonate lens on various lens machines, such as Coburn or CNC Grinding Equipment. The cycle provides at least one wet revolution and one dry revolution with coolant flow to the wheel at least on the final polishing step. The resulting lens has a high luster edge approaching optical quality.

It is to be appreciated that the lens can be subjected to multiple wet/dry cycles prior to the polishing step to enhance material removal and finish requirements prior to the final polishing step.

While the above description constitutes the preferred embodiments of the present invention, it is to be appreciated that the invention can be practiced in ways other than that specifically disclosed without deviating from the scope or the fair meaning of the present invention as set forth in the accompanying claims.

What is claimed is:

1. A process for polishing of the optical surface of a polycarbonate lens comprising the steps of:

a) providing an optical lens made of a polycarbonate material having an unground optical surface;

b) providing a rough forming wheel having a radiused edge and rough grinding the optical surface of the lens;

c) providing a polishing wheel having a radiused edge having abrasive particles of a size from about 2 microns to about 60 microns;

d) polishing at least a portion of said optical surface by causing said polishing wheel to contact said portion of said optical surface to be polished at least once and with a coolant flow or an increased coolant flow;

e) causing said polishing wheel to contact said portion of said optical surface to be polished at least once without the use of a coolant flow or with a coolant flow of about 8 ounces per minute or less, wherein a final finish substantially equal to a finished optical surface of the lens is produced.

2. The process of claim 1, further comprising using a lapper to finish polish the lens.

3. The process of claim 2, wherein said step of providing a polishing wheel includes providing a polishing wheel having an abrasive material from about 10 concentration to about 200 concentration of abrasive grit material.

4. The process of claim 2, wherein said step of providing a polishing wheel includes providing an impregnated polishing wheel having abrasive grit particles in a size of from about 10 to 30 microns.

5. The process of claim 2, wherein said step of providing a polishing wheel includes providing an impregnated bonded polishing wheel having from about 35 to about 150 concentration of diamond particles as said abrasive grit.

6. The process of claim 5, wherein said step of providing a polishing wheel includes providing an impregnated polishing wheel having from 75 to about 125 concentration of diamond particles as said abrasive grit.

7. The process of claim 2, wherein said step of providing a polishing wheel includes providing an impregnated polishing wheel having abrasive grit particles of from about 7 to about 30 microns in size.

8. The process of claim 2, wherein said step of providing a polishing wheel includes providing an impregnated polishing wheel having abrasive grit particles of from about 15 to about 20 microns in size.

9. The process of claim 2, wherein said step of providing a polishing wheel includes providing an impregnated polishing wheel having abrasive grit particles of from about 8 to about 12 microns in size.

10. The process of claim 1, wherein the polishing wheel contacts the optical surface of the lens a plurality of times with the use of coolant flow.

11. A process for grinding and polishing a polycarbonate lens, said method comprising the steps of:

providing an optical lens made of a polycarbonate material having a rough optical surface;

providing a rough grinding wheel;

grinding the rough optical surface of the lens with the rough grinding wheel without the use of a coolant;

providing a polishing wheel for polishing the optical surface of the lens; and polishing the optical surface with the polishing wheel after the step of grinding with the rough grinding wheel by causing the polishing wheel to contact the rough edge surface at least once with a coolant flow, and at least once without a coolant flow or with a decreased coolant flow of less than about 8 ounces per minute.

* * * * *